United States Patent [19]

Roy

[11] 4,240,340

[45] Dec. 23, 1980

[54] APPARATUS FOR FORMING AND STRAPPING A PACK

[75] Inventor: Michel Roy, Paris, France

[73] Assignee: LOGISAC Groupement d'Interet Economique Regi par l'Ordonnance, Paris, France

[21] Appl. No.: 56,618

[22] Filed: Jul. 11, 1979

Related U.S. Application Data

[62] Division of Ser. No. 953,179, Oct. 20, 1978.

[30] Foreign Application Priority Data

Oct. 28, 1977 [FR] France ..... 77 32684

[51] Int. Cl.³ ..... B65B 13/18

[52] U.S. Cl. ..... 100/7; 100/2; 100/14; 414/45

[58] Field of Search ..... 100/2, 7, 14; 414/45

[56] References Cited

U.S. PATENT DOCUMENTS

| | | | |
|---|---|---|---|
| 2,609,923 | 9/1952 | Simonton | 100/14 X |
| 3,057,289 | 10/1962 | Luthi | 100/14 X |
| 3,642,151 | 2/1972 | Hayes | 414/45 |
| 3,688,920 | 9/1972 | Frish | 414/45 |

FOREIGN PATENT DOCUMENTS

| | | | |
|---|---|---|---|
| 1077421 | 7/1967 | United Kingdom | 100/7 |

*Primary Examiner*—Billy J. Wilhite

[57] ABSTRACT

A pack comprising a plurality of superposed layers of unit loads and at least one strap encircling said plurality of superposed layers. The bottom layer of the pack has formed therein at least one elongated free space or channel extending in a direction parallel to the axis of the loop of said at least one strap and capable of accommodating the arms of the fork of a lift truck. The strap or straps have a low tension, but when the arms of the lift truck fork are upwardly engaged into the free spaces, the straps are tightened and firmly hold the load which can therefore be handled safely. The straps slacken when the pack is deposited on top of another pack, thereby allowing the upper pack to chocke itself onto the lower pack and thereby allowing to form columns of stacked packs with a greater number of packs and a higher degree of safety than with hitherto known packs.

4 Claims, 7 Drawing Figures

APPARATUS FOR FORMING AND STRAPPING A PACK

This is a division of application Ser. No. 953,179 filed Oct. 20, 1978.

BACKGROUND OF THE INVENTION

1. Field of the Invention

This invention pertains to the domain of material handling and relates more particularly to a pack of the type comprising a plurality of superposed layers or tiers of unit loads and at least one strap encircling said plurality of layers.

The present invention is applicable notably but not exclusively to packs of which the unit loads consist of bags filled with loose material. In many cases unit loads of this type must be stored in large quantities in warehouses before actually distributing and utilizing them. As a rule, the bags are transported by road or railroad trucks to the warehouse where they are subsequently discharged and re-grouped to form packs comprising each a plurality of superposed layers or tiers of bags, each pack being bound by means of at least one strap. Each pack thus formed is picked up and transported by a lift truck to the storage place proper where the packs are laid side by side and superposed to constitute a stack comprising several contiguous "walls", each wall comprising several contiguous columns of packs.

2. Description of the Prior Art

As a rule, packs of this character are handled by using pallets or a special pick-up system. In this last case, to prevent the packs from getting loose during the handling and to allow handling thereof with the maximum safety, the strap or straps encircling the pack must be extremely tight, so that the unit loads constituting such pack form a compact, tight assembly. As a result, the inner and upper surfaces of the packs tend to assume a convex shape, thus impairing the stability of the columns formed thereby. It follows that only four or five packs can be stacked in each column. Moreover, the upper packs in each column must be chocked up in most cases and this operation requires the presence of several persons on top of the stacks for chocking up the unstable packs. Now, this not only increases the number of hands necessary for performing the handling operations but also aggravates the danger of falling for the persons working on top of the stack, considering the lacks of stability of the columns. Moreover, since the height available in warehouses is much greater than the height of the columns of packs that can be made with hitherto known pack arrangements, a valuable vertical space is lost without profit.

It is the main object of the present invention to avoid the inconveniences disclosed hereinabove by providing a pack having a particular structure such that a relatively large number of such packs can be superposed to form a column of great height and great stability without resorting to pallets or the like.

Another object of the invention is to provide a machine for making such packs.

DESCRIPTION OF THE INVENTION

The pack according to the present invention is characterized in that the bottom layer of said plurality of superposed layers comprises at least one free space or channel of elongated configuration and predetermined witht, which extends in a direction parallel to the axis of the loop formed by the strap said, free space or channel being straddled or bridged transversely by said strap, and said strap has a relatively low tension.

This pack may be obtained by so disposing the unit loads constituting the bottom layer that at least one channel or free space of predetermined width and elongated configuration is formed therein in a predetermined direction, and by strapping the plurality of pack-forming layers with at least one strap having a relatively low tension by forming with the strap a loop of which the axis is substantially parallel to said predetermined direction.

The number of free spaces and their locations in the bottom layer are subordonate to the number and relative spacing of the arms of the fork of the lift truck utilized for handling the packs. For picking up a pack, the fork arm or arms of the lift truck is or are placed underneath the strap or straps passing under the bottom layer of load units and longitudinally in registration with the corresponding free space or spaces formed in said bottom layer. When the fork arm or arms are moved upwards for picking up the pack, they tighten the strap or straps, while causing the latter to penetrate into the corresponding free space or spaces. The pack forming bags are thus firmly tightened or pressed close together and the pack can be handled with the maximum degree of safety. When the pack is subsequently deposited upon the floor or laid on top of another pack, the strap or straps released by the fork arm or arms are allowed to slacken and to resume their initial low tension. Consequently, the pack forming bags can thus resume their initial shape. More particularly, when the bags are filled with loose material such as pulverulent materials, grains or the like, the slackening of the strap or straps that takes place automatically when the pack is deposited upon the floor or on top of another pack enables the loose products contained in said bags, and more particularly those contained in the bags of the bottom layer, to resume their initial configuration or to conform to the shape of the surface on which the pack is laid. As a result, the packs are caused or allowed to chock themselves automatically on one another, so that columns of stacked packs can be erected which are characterized by a great stability and a greater number of packs in comparison with columns of packs made according to the prior art technique.

The present invention also provides a machine for making packs having the specific structure described hereinabove. The pack making machine according to the invention comprises in a known manner a pack forming device, a pack strapping device, a discharge station and a conveyor capable of transferring a pack from the pack forming device through the pack strapping device to the discharge station, and is characterized in that the pack forming device comprises retractable means for positioning the unit loads constituting the bottom layer of the pack being formed, said positioning means being capable, in an operative non-retracted position, to provide at least one free space in the bottom layer of the pack being formed.

DESCRIPTION OF THE PREFERRED EMBODIMENTS

Figure 1:
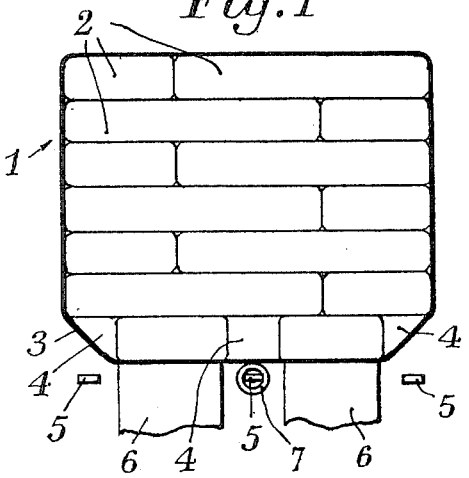
FIG. 1 is a diagrammatic elevational view showing a first embodiment of a pack according to the invention, which is adapted to be handled by means of a lift truck equipped with a three-armed fork.

The pack 1 illustrated in FIG. 1 comprises a plurality of layers, for example seven layers, of unit loads 2. The seven layers are strapped by means of two straps 3 only one of which is visible in FIG. 1, but the two straps are clearly visible in FIG. 6). Each strap 3 may consist for example of a length of flexible plastic tape about 16 mm wide looped around the pack. The unit loads 2 may consist for example of bags containing loose or pulverulent material, such as sugar. In the example illustrated in FIG. 1, the bags 2 have a length which is approximately twice their width. The first or bottom layer comprises two bags which are spaced a predetermined distance from each other and so disposed that their length extends substantially at right angles to the plane of FIG. 1. The second layer comprises three bags, namely a first bag shown on the right-hand side of the pack of FIG. 1 and disposed with the same orientation as the two bags of the bottom layer, and second and third bags (only one being visible on the left of said first bag in FIG. 1) which are disposed transversely in relation to the two bags of the first or bottom layer. The third layer also comprises three bags, but in this case the bag having the same orientation as the two bags of the bottom layer is disposed on the left-hand side of the pack, and the other two bags, disposed transversely in relation to the two bags of the bottom layer, are located on the right-hand side. The fourth and sixth layers are identical with the second layer, and the fifth and seventh layers are identical with the third layer.

In brief, the bags 2 of the second to seventh layers are disposed according to the well known crossed-layer arrangement. On the other hand, the bottom layer comprises only two bags 2 spaced from each other. Thus, three elongated spaces or gaps 4 are formed in the bottom layer, with their major dimension extending at right angles to the plane of FIG. 1, i.e. parallel to the axis of the loop formed by the straps 3.

Figure 2:
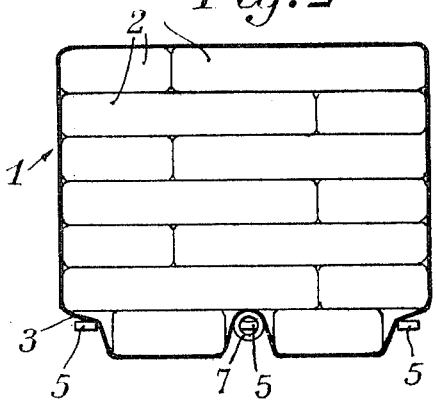
FIG. 2 is a view similar to FIG. 1 showing the manner in which the three arms of the lift truck fork operate, when picking up the pack, for tightening the pack encircling straps.

By way of example, not of limitation, each bag 2 may have a length of about 800 mm, a width of about 400 mm and a height or thickness of about 157 mm. In case the bage 2 contained castor or granulated sugar, each bag may weight approximatively 50 kilograms. In this example, a pack 1 as shown in FIG. 1, consisting of 20 bags, will weight about one metric ton and have dimensions corresponding substantially to the European pallet, i.e. 1,200 mm×800 mm, and a height of about 1,100 mm. The pack 1 may be handled by means of a lift truck equipped with a three-armed fork, each arm 5 having a length of about 800 mm and a width of about 50 mm, with the central arm spaced about 530 mm from the two lateral arms. To permit of picking up the pack 1 by means of the three-armed fork 5 of the lift truck, the pack 1 is supported by a pair of suitable support members 6 (FIG. 1) disposed underneath the pair of bags 2 of the bottom layer, as shown in FIG. 1. If desired, a cardboard tube having a diameter of about 100 mm and a wall thickness of about 5 mm may advantageously, but not compulsorily, be disposed between the two support members 6, just under the strap 3 and plumb to the free central gap 4 which, in the example contemplated hereinabove, has a width of about 135 mm. For picking up the pack, the truck operator engages the central arm of the lift truck fork into the tube 7 while the two lateral arms of the fork will position themselves under the two lateral free spaces 4 of the bottom layer, as shown in FIG. 1. Then, as the truck fork is raised, the tube 7 and the two lateral arms 5 engage the straps 3 to tighten them as shown in FIG. 2. Consequently, the bags 2 of pack 1 are firmly held by the straps and can be handled without any risk. The advantage of using the carboard tube 7 lies in the fact that when the pack 1 is laid on the floor or on the top of another pack, and the fork is subsequently retracted, the tubes 7 moves downward to the bottom of the bottom layer of bags, thus allowing the straps 3 to slacken while preserving a passage for the central arm of the lift truck fork in view of a subsequent pick-up. When laying down the pack 1, the straps are slackened and thus the product contained in the bags is allowed to spread somewhat and resume its natural position in the bags. Thus, when the pack 1 is stacked on top of another pack, the two bags forming the bottom layer of the upper pack can conform freely to the top surface shape or relief of the underlying pack, so that the upper pack will "clocke" itself automatically in relation to the underlying pack. With packs having the above-mentioned dimensions, it is possible to stack such packs to form columns comprising up to seven or more packs, with a definitely improved stability, compared with that of packs made according to the prior art technique.

Figure 3:
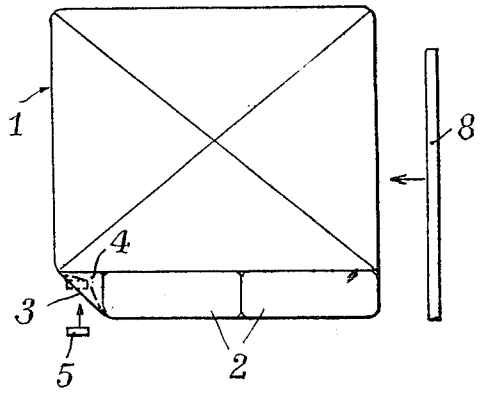
FIG. 3 to 5 are views similar to FIG. 1 showing other embodiment of the pack according to the invention, which are adapted to be handled by means of a lift truck equipped with a single-arm or two-armed fork, respectively.
Figure 4:
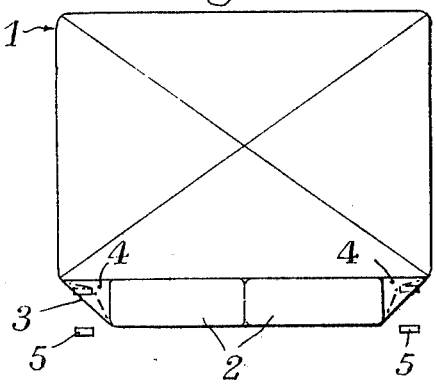
Figure 5:
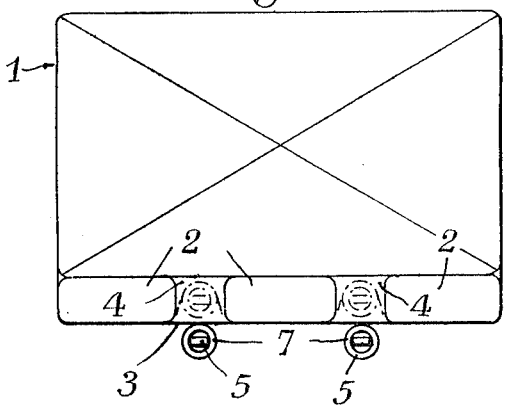

The pack 1 described hereinabove with reference to FIGS. 1 and 2 of the drawings comprises three free spaces or gaps 4 in its bottom layer. However, it would not constitute a departure from the basic principles of the present invention to use a different number of such spaces or gaps. In fact, the number and location of the free spaces 4 in the bottom layer will depend on the particular type of lift truck to be used, and more particularly on the number and relative spacing of the arms of the lift truck fork, and also on the dimensions of the unit loads constituting the pack. FIGS. 3 to 5 illustrate by way of example, not of limitation, other arrangements that can be used for the bags constituting the bottom layer of the pack.

The bottom layer of the pack illustrated in FIG. 3 comprises a single free spaces 4 located on one of the two sides of the bottom layer which is parallel to the axis of the loop formed by the strap or straps 3. This particular pack may be handled by means of a lift truck of which the load engaging means comprise a single arm 5 and an apron 8.

The bottom layer of the pack 1 illustrated in FIG. 4 comprises two free spaces 4 located on either side of the bottom layer, respectively, and parallel to the axis of the loop formed by the strap or straps 3. This pack may be handled by means of a lift truck equipped with a two-armed fork 5, the relative spacing of these arms corresponding to that of the two free spaces 4.

The bottom layer of the pack 5 shown in FIG. 5 comprises also two free spaces 4, but in this case the two spaces 4 are equally spaced from the sides of the bottom layer and parallel to the axis of the loop formed by the strap or straps 3. This pack may be handled by means of a lift truck equipped with a fork having two arms disposed at the same relative spacing as said free spaces 4. A pair of tubes 7 engageable by the two arms 5 of the lift truck fork may advantageously be used for picking up the pack.

Figure 6:
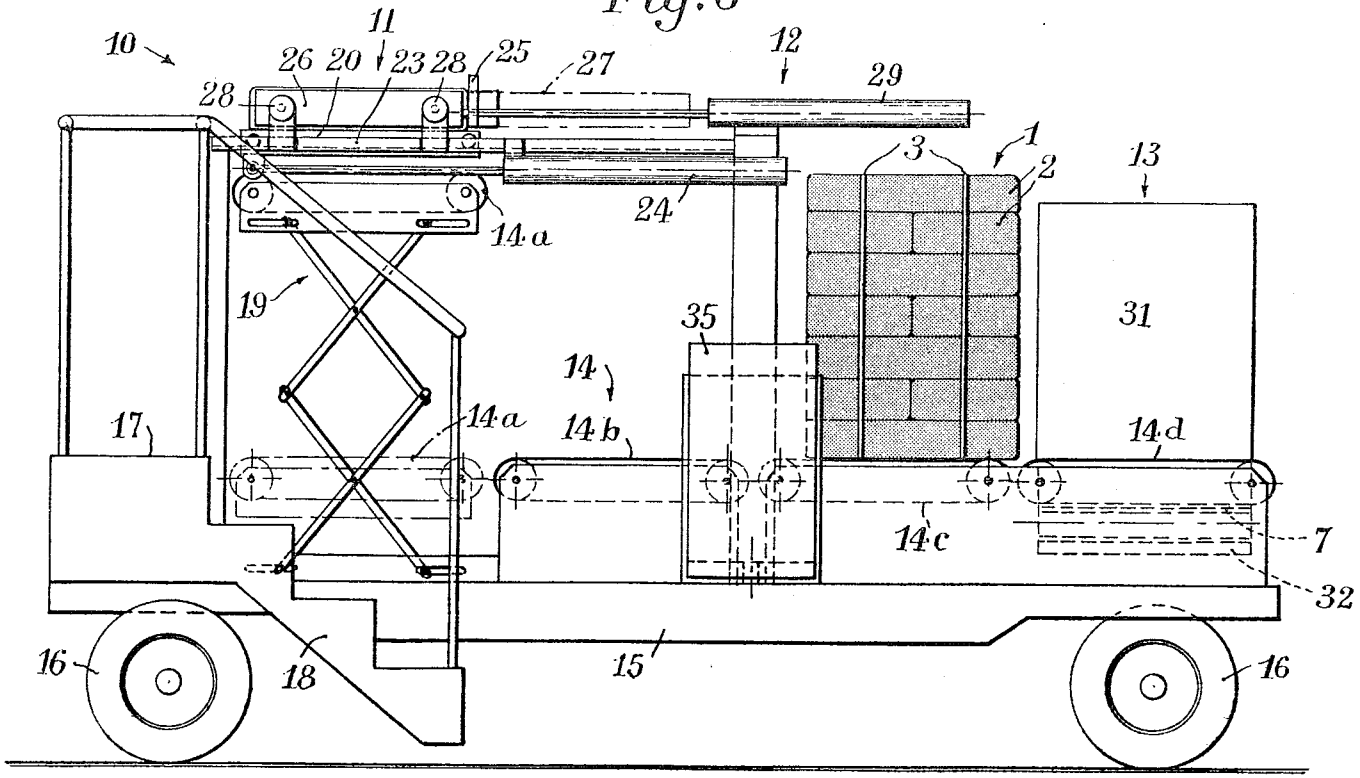
FIG. 6 is a diagrammatic side elevational view showing a machine for making the pack illustrated in FIG. 1.
Figure 7:
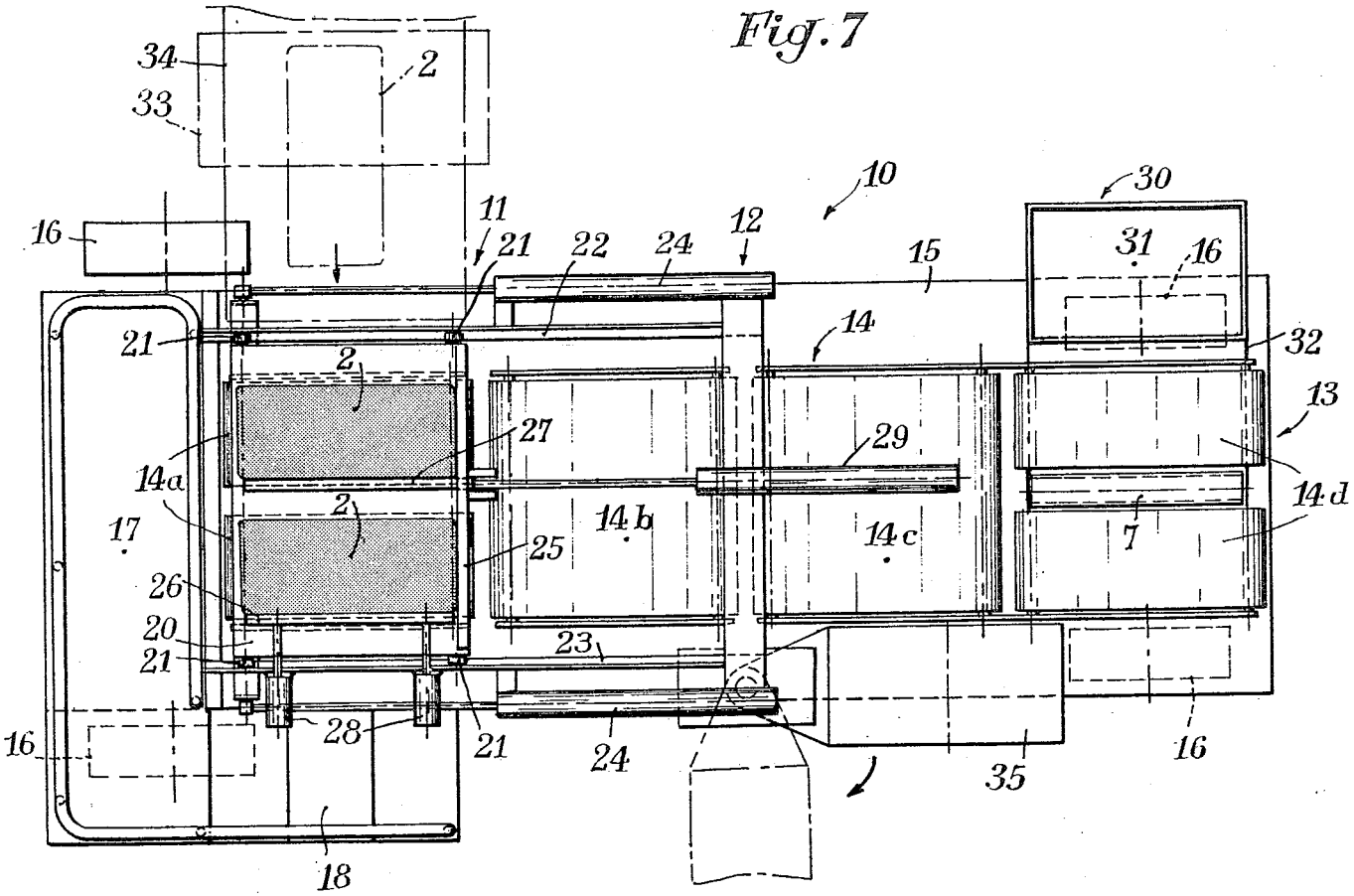
FIG. 7 is a diagrammatic plane view from above of the machine shown in FIG. 6.

Now reference will be made to FIGS. 6 and 7 illustrating diagrammatically a machine for making packs of the type illustrated in FIG. 1. The machine comprises in a known manner a pack forming device 11, also called "palletizer", for forming unit loads or bags 2 into a layer or tier and for stacking successive layers of unit loads to form a pack 1, a strapping device 12, a discharge station 13 and a conveyor system 14 adapted to transfer a completed pack from the pack forming device 11 through the strapping device 12 to the discharge station 13. All these component elements may be mounted on a frame 15 supported preferably by four wheels 16, of which two are steerable, so that the machine can easily be brought close to the place where the bags 2 are discharged, for example by means of a lift truck (not shown used as a tractor. Mechanical jacks (not shown) may be provided for propping the frame 15 on the working site. At its left end (as seen in FIGS. 6 and 7), i.e. close to the pack forming device 11, the machine 10 comprises a working platform 17 to which access may be had through stairs 18.

The pack forming device 11 comprises an elevator 19 movable between an upper position shown in thick lines in FIG. 6 and a lower position shown in phantom lines in the same Figure. The distance between the upper and lower positions of elevator 19 is slightly greater than the height of the pack 1 to be obtained, for example a little more than seven times the height or thickness of a bag 2 in case the pack 1 is to comprise seven layers of bags. The elevator 19 supports a first conveyor 14*a* comprising for example a pair of endless conveyor belts spaced in the transverse direction as shown in FIG. 7, so as to support the two bags 2 of the bottom layer of pack 1 being formed, respectively. A rectangular substantially horizontal tray 20 provided with rollers 21 is adapted to roll on a pair of track rails 22, 23 extending substantially horizontally and supported at a level overlying the upper position of conveyor 14*a* by means of a suitable support structure (not shown in order to simplify and clarify FIGS. 6 and 7 of the drawings).

The tray 20 is adapted to be moved in a substantially horizontal plane by means of a pair of hydraulic or pneumatic double-acting cylinders 24 between a first position overlying the conveyor 14*a* and a second position somewhat spaced from the conveyor 14*a*. The major sides of the tray 20 extend transversely to the longitudinal direction of movement of conveyor 14*a* and their length is substantially equal to the sum of the length and width of a bag 2. A fixed vertical positioning plate 25 is disposed above and along one of the major sides of tray 20 when the latter is in its first position. The positioning plate 25 may be secured to the rails 22 and 23 or to their supporting structure.

The pack forming device 11 further comprises retractable means for positioning the bags 2 constituting the bottom layer of the pack 1 during the formation thereof, said retractable positioning means, when in their operative non-retracted position, being arranged to provide at least one free space or channel in the bottom layer of the pack being formed.

In case the machine 10 is intended for making packs of the type illustrated in FIG. 1, the retractable positioning means may comprise a pair of vertical plates 26, 27 disposed at right angles to the fixed vertical plate 25 and lying just above the tray 20 when the latter is in its first position. The vertical plate 26 is movable horizontally by means of a pair of double-acting hydraulic or pneumatic cylinders 28 from a first retracted position along one of the minor sides of tray 20 to a second non-retracted position (shown in thick lines in FIG. 7) at a predetermined distance from said one minor side of tray 20 toward the middle of said tray. The vertical plate 27 is movable horizontally by means of another double-acting pneumatic or hydraulic cylinder 29 from a first retracted position (shown in phantom lines in FIG. 6) somewhat spaced from tray 20 to a second non-retracted position (shown in thick lines in FIG. 7) located at a distance from the other minor side of tray 20 which is equal to the sum of said predetermined distance and the width of a bag 2. The fixed vertical plate 25 comprises a vertical slot or is divided into two sections to permit the passage of the vertical plate 27 from its first position to its second position, and vice versa.

The conveyor system 14 comprises, in addition to conveyor 14*a*, three other conveyors 14*b*, 14*c* and 14*d* disposed in series and at the same level as conveyor 14*a* when the elevator 19 is in its lower position. Conveyor 14*d* is located at the discharge station 13 and comprises a pair of endless conveyor belts spaced transversely to each other in the same fashion as the pair of conveyor belts of conveyor 14*a*. Laterally of the discharge station 13 a tube distributor 30 is provided for delivering tubes 7 separately to the space located between the two conveyor belts of conveyor 14*d*. The distributor 30 may comprise for example a tube magazine 31 of which the bottom communicates with a curved chute 32 passing underneath one of the pair of belts of conveyor 14*d* so as to deliver the tubes 7 one by one by gravity into said space. The pair of conveyor belts 14*d* may act as the supports 6 of FIG. 1.

Now the mode of operation of the machine 10 described hereinabove will be described in detail. The bags 2 unloaded from a road or railroad truck are shaped in a known manner, for example by means of a flattening vibrator 33, and are subsequently transferred in the longitudinal direction to the pack forming device 11 by means of one or a plurality of conveyors 34, as illustrated in phantom lines in FIG. 7. To form the bottom layer of pack 1, the elevator 19 and the conveyor 14*a* are brought to their upper position shown in FIG. 6, the tray 20 is brought by actuating the pair of cylinders 24 to its first position overlying the conveyor 14*a*, the vertical plate 27 is retracted to the position shown in phantom lines in FIG. 6 by actuating the cylinder 29, and the vertical plate 26 is brought to the position shown in thick lines in FIG. 7 by actuating the pair of cylinders 28. The first bag 2 discharged by conveyor 34 upon the tray 20 is oriented in a parallel direction to the longitudinal direction of conveyor 14*a* and thrusted into the corner formed between plates 25 and 26 by an operator standing on the working plat form 17. The operator subsequently actuates for example by means of a control pedal (not shown) the cylinder 29 in order to move the vertical plate 27 to the operative position shown in FIG. 7. Then, the second bag delivered by conveyor 34 upon the tray 20 is oriented longitudinally by the operator and also thrusted into the corner formed between the vertical plates 25 and 27. To facilitate the proper orientation and positioning of bags 2 in engagement with the vertical plates 25, 26 and 27, the top surface of tray 20 may be lined with a suitable material, for example a great number of balls, on which the bags 2 can easily be moved and turned as required. In a modified embodiment, the tray 20 may be of the fluidized type, i.e. provided with a great number of small nozzles delivering as many jets of compressed air to create an air cushion under the bags 2 laid upon the tray 20. Moreover, the rail 23 may be set at a level slightly lower than that of rail 22, and the two rails 22 and 23 may be slightly inclined downwards from the horizontal towards the right-hand end of the machine 10, as seen in FIGS. 6 and 7, whereby the bags 2 will engage automatically by gravity the vertical plates 25 and 26 or 25 and 27. The first pair of bags 2 positioned by the vertical plates 25, 26 and 27 as shown in FIG. 7 constitute the bottom or base layer of the pack to be formed. It will be noted that the vertical plate 26 permits of forming the free space or channel 4 on one of the two sides of the bottom layer of the pack 1 shown in FIG. 1, and that the vertical plate 27 permits of forming the other two free spaces or channels 4 located centrally of the bottom layer and on the side thereof opposite the free space formed by vertical plate 26.

When the bottom layer of pack 1 has been completed as described hereinabove, the tray 20 is moved in a substantially horizontal plane away from the elevator 19 by the pair of cylinders 24. During this movement of tray 20, the two bags 2 of the bottom layer are retained by the vertical plate 25 and fall upon the endless belts, respectively, of conveyor 14*a*. The elevator 19 is then lowered to the extent of one height or thickness ob a bag 2, and the tray 20 is moved back to its first position above the bags 2 of the bottom layer by the pair of cylinders 24. Then, the vertical plate 26 is brought back to its retracted position along the minor side of tray 20 by the pair of cylinders 28 and the vertical plate 27 is moved by cylinder 29 to its retracted position shown in phantom lines in FIG. 6. Both plates 26 and 27 are held in their retracted position during all the time necessary for completing the following layers of bags of pack 1. To make the second layer of pack 1, the operator positions the third bag delivered by conveyor 34 against the vertical plates 25 and 26 with an orientation perpendicular to that of the two bags of the bottom layer; the fourth bag is disposed with the same orientation as the third bag so as to engage said third bag and the vertical plate 26; then, the fifth bag is disposed with the same orientation as the two bags forming the bottom layer against the vertical plate 25 and against the adjacent ends of the third and fourth bags. The thus formed second layer is subsequently laid upon the bottom layer by retracting the tray 20 by means of cylinders 24. If desired, chocks may be provided on the top of elevator 19 between the two conveyor belts of conveyor 14*a* and on either side thereof to support the bag portions of the second layer which are not supported by the bags of the bottom layer. After having lowered for the second time the elevator 19 to the extent of one bag thickness and after having subsequently restored the tray 20 to its first position, the third layer of pack 1 can be formed. For this purpose, the sixth bag delivered by conveyor 34 is disposed by the operator with the same orientation as the two bags forming the bottom layer against the vertical plates 25 and 26, the seventh bag is disposed with an orientation at right angles to that of the bags of the bottom layer against the plate 25 and the sixth bag, and the eighth bag is disposed with the same orientation as the seventh bag against the sixth and seventh bags. The thus formed third layer is then laid upon the second layer. The next layers are formed in a similar manner, with the bags 2 of the fourth and sixth layers disposed like those of the second layer, and the bags 2 of the fifth and seventh layers disposed like those of the third layer, so as to constitute successive crossed layers.

Once the seven layers forming the pack 1 are formed in the manner set forth hereinabove, the seven layers are transferred by conveyors 14*a* and 14*b* to the strapping device 12. The strapping device 12, which may be of any known and suitable type, fits successively two bonds or straps 3 around the pack 1. However, for carrying out the present invention, the strapping device 12 is so adjusted that the bonds or straps 3 surrounding the pack 1 have a low tension. Furthermore it will be noted that the axis of the loops formed by the two bonds 3 is parallel to the longitudinal direction of the free spaces or channels formed or left between the bags forming the bottom layer. As mentioned in the foregoing, the strap material utilized for forming the bonds 3 may consist of a plastic tape about 16 mm wide. The tape may be delivered to the strapping device 12 from a coil mounted in a support 35 pivotally mounted to one side of the frame 15 between an operative position shown in thick lines in FIG. 6 and in phantom lines in FIG. 7, and a transport or inoperative position shown in thick lines in FIG. 7.

When strapped the pack 1 is transferred by conveyors 14*c* and 14*d* to the discharge station 13 from which it can be picked up together with a tube 7 by an elevator truck in the manner already described hereinabove with reference to FIGS. 1 and 2 of the drawings.

The travel or feed movement of pack 1 from the pack forming device 11 to and through the strapping device 12, the successive stops of the pack at two strapping positions in strapping device 12, and at a waiting position in the discharge station 13, and the strapping operations proper, may be controlled automatically, if desired, for example by means of control signals transmitted from sensors, such as photocells, disposed at suitable locations along the path followed by the pack 1. Consequently, only one operator is sufficient for controlling and operating the machine 10, namely the operator standing on the platform 17. He can control the operation of cylinders 24, 28 and 29, and also of elevator 19 from a suitable control panel or switchboard (not shown).

Of course, while a pack 1 is being strapped or waiting at discharge station 13, it is possible to start building up the next pack. In case each pack comprises twenty bags weighing 50 kilograms each, making a total of one metric ton, the machine 10 may operate with an output of 30 metric ton per hour.

Of course, the embodiments of the present invention which have been described hereinabove should not be construed as limiting the scope of the invention, since they are given by way of example only. Therefore, many modifications and constructional details may be modified without inasmuch departing from the basic principles of the invention, which are clearly set forth in the following claims.

What is claimed as new is:

1. A machine for making a pack of unit loads, comprising a pack forming device for forming said unit loads into a plurality of superposed layers including a bottom layer and each layer having a plurality of unit loads, a strapping device for setting at least one strap in a loop around said plurality of superposed layers of unit loads, a discharge station and a conveyor system capable of transferring a pack from the pack forming device through said strapping device to said discharge station, wherein said pack forming device includes retractable means for positioning the unit loads of the bottom layer of the pack being formed, said retractable positioning means being capable when in an operative non-retracted position, to provide in the bottom layer of the pack being formed at least one free space of predetermined width and elongated configuration extending parallel to the axis of the loop formed by said at least one strap, and wherein said strapping device is so adjusted to set said at least one strap around the pack with a low tension.

2. A machine as claimed in claim 1 for forming a pack of which the unit loads have predetermined length, width and height, wherein said pack forming device comprises an elevator movable between an upper position and a lower position, a conveyor supported by said elevator, a substantially horizontal rectangular tray having two major sides disposed transversely to the longitudinal direction of motion of said conveyor and having a length substantially equal to the sum of the length and width of a unit load, and two minor sides extending in the longitudinal direction of said conveyor and having a length substantially equal to the length of one unit load, said tray being movable substantially horizontally between a first position in which it overlies said conveyor in the upper position thereof and a second position away from said conveyor, and a fixed vertical positioning plate located above and along one of the major sides of said tray when said tray is in its first position, and wherein said retractable positioning means comprise two movable vertical plates disposed at right angles to said fixed vertical plate and above said tray in the first position thereof, a first one of said two vertical plates being movable horizontally between a first position located along one of the two minor sides of said tray and a seond position located at a predetermined distance from said one minor side of the tray inwardly thereof, to provide a first free space in the bottom layer on one side thereof, the second one of said two vertical plates being movable between a first position away from said tray and a second position located at a distance from the other one of the two minor sides of said tray which is equal to the sum of said predetermined distance and the width of a unit load, to form second and third free spaces in said bottom layer, respectively in the middle thereof and on the side thereof opposite said first free space.

3. A machine as claimed in claim 2, wherein in said discharge station said conveyor system comprises two endless conveyor belts spaced transversely from each other in relation to their longitudinal direction by a distance corresponding to the width of said second free space.

4. a machine as claimed in claim 3, wherein a tube distributor is provided adjacent said discharge station for feeding tubes one by one into the space between said pair of endless conveyor belts.

* * * * *